United States Patent [19]

DeFelice

[11] Patent Number: 4,763,675

[45] Date of Patent: Aug. 16, 1988

[54] FINE TOOTH COMB

[76] Inventor: Amedio DeFelice, 251 Florence St., Leominster, Mass. 01453

[21] Appl. No.: 58,383

[22] Filed: Jun. 5, 1987

[51] Int. Cl.[4] ..... A45D 24/04

[52] U.S. Cl. ..... 132/137; 132/11 R

[58] Field of Search ..... 132/11 R, 137, 125, 132/138, 139, 140, 141; 119/83, 90, 87; 15/142; D28/21, 28, 29

[56] References Cited

U.S. PATENT DOCUMENTS

| | | | |
|---|---|---|---|
| 3,216,428 | 11/1965 | Hallman | 132/137 |
| 3,797,506 | 3/1974 | Reinsch | 132/137 |
| 4,502,498 | 3/1985 | Saferstein et al. | 132/11 R |
| 4,612,944 | 9/1986 | Bachrach et al. | 132/11 R |
| 4,612,945 | 9/1986 | Bachrach | 132/137 |

FOREIGN PATENT DOCUMENTS

| | | | |
|---|---|---|---|
| 826623 | 11/1951 | Fed. Rep. of Germany | 132/137 |
| 2405042 | 6/1979 | France | 132/11 R |

*Primary Examiner*—John Weiss

*Attorney, Agent, or Firm*—Charles R. Fay

[57] ABSTRACT

A fine tooth comb wherein the teeth are provided with shoulder ledges along the narrowest part of the passages between teeth, the shoulder ledges being alternate in direction, and cooperating to form offsets or jogs in the passages for better detritus removal.

1 Claim, 1 Drawing Sheet

FIG. 1
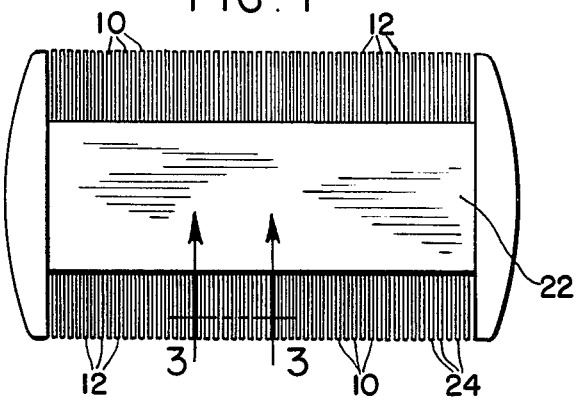
FIG. 2
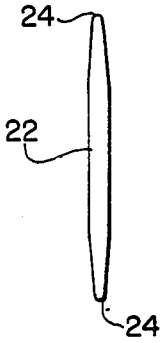
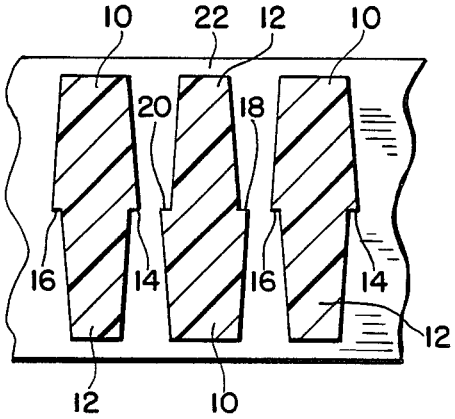
FIG. 3
FIG. 4
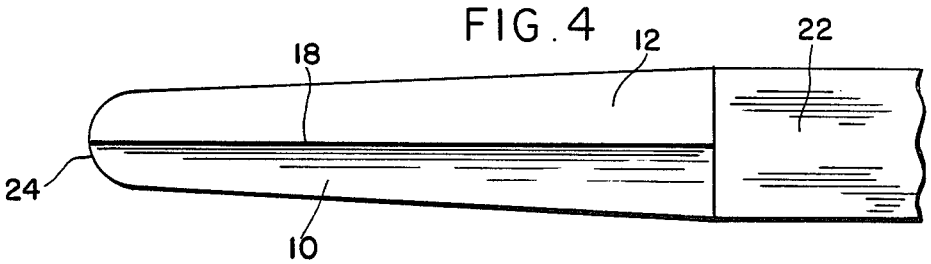
FIG. 5
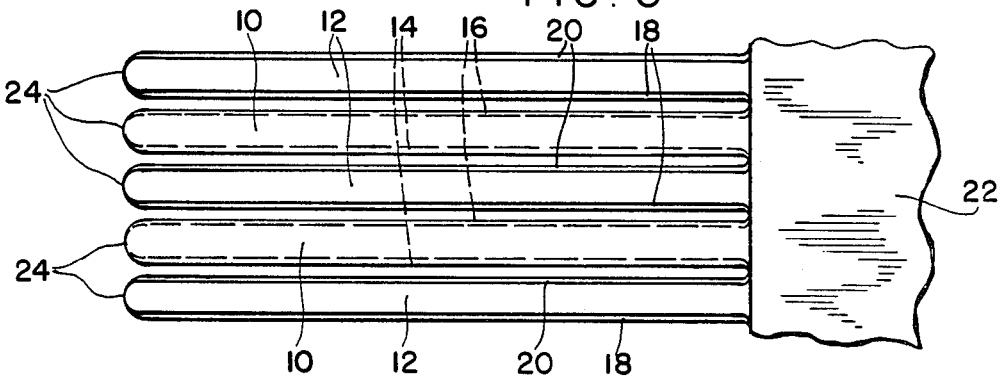

FINE TOOTH COMB

BACKGROUND OF THE INVENTION

Fine tooth combs are old and well-known, their main purpose being to comb detritus out of the hair, including fleas and the like. These combs can remove some dandruff because it is inert and generally greasy, so that it piles up on the small, closely spaced comb teeth. Less sticky dandruff and other material including fleas, are not combed out as well, and one reason appears to be that the facing side surfaces of the small comb teeth form a smooth passage in addition to the fact that fleas et al can resist being combed out.

It is the purose of this invention to provide a novel comb tooth structure that will comb out all kinds of detritus and fleas and other things that are difficult to remove from the hair by a comb.

SUMMARY OF THE DISCLOSURE

Starting with the mental picture of one of the old and well-known fine-tooth combs, the present invention varies the usual teeth with teeth of a like size which have a length, width, and thickness in generally similar dimensions, by applying to the facing parts of adjacent teeth a means to catch a detritus better and more efficiently. This means comprises a wider one-half of the tooth width alternating with a narrower one-half tooth, the teeth being alternately inverted so that each wider part lies between a pair of narrower parts as to the next adjacent teeth, at each side or face of the comb. The wider parts form a pair of shoulders, one at each side of each tooth, the shoulders forming ledges that form jogs in the passages between teeth, so that loose material of all kinds is caught by the ledges and remains with the comb and is thus removed from the hair.

BRIEF DESCRIPTION OF THE DRAWINGS

FIG. 1 is a plan view of a fine tooth comb;

FIG. 2 is an end view thereof;

FIG. 3 is a sectional view on an enlarged scale on line 3—3 of FIG. 1;

FIG. 4 is a view of one tooth showing the side thereof at one side, and

FIG. 5 is a top plan view.

PREFERRED EMBODIMENT

FIGS. 1 and 2 simply show the type of comb to which this invention is applicable, to present a better idea of what the inventive structure is like, and it should be kept in mind that a superficial inspection will not at first glance let the user know that there is a material improvement.

Each of the novel teeth has a wider part 10 and a narrower part 12, these parts being in effect one-half portions of the respective tooth. These teeth are alternately inverted as shown in FIG. 3, and the junctions of the wider and narrower parts form shoulders as at 14, 16, 18, and 20. The shoulders form edges that run centrally of the comb teeth side faces from or near the back22 to a point to or near the tooth points 24, see FIG. 4.

The teeth structures are alternately inverted, so that shoulder ledge 16 cooperates with shoulder ledge 18 to form a narrow throat with a material catching ledge at each side of it, facing in opposite directions, to catch material passing through between teeth in either direction, the shoulder ledges being only on the wider parts 10. A kind of jog is also formed, enhancing the detritus catching action.

The teeth parts all taper from the outer edges to the center, whereby in some cases a compression of the material to be combed out is made, and the shoulder ledges are at the centers of the passages between teeth. The tapering also allows injection molding, the draft here being small but effective.

I claim:

1. A fine tooth comb having a narrow elongated back and a row of generally co-planar parallel closely spaced teeth formed integrally with said back and extending in substantially the same direction away from said back, said comb having a pair of opposite faces, one on each side of a central longitudinal plane through said comb, each of said teeth having an end remote from said back and being substantially uniformly longitudinally tapered from said back to a point adjacent said end, each of said teeth further being of substantially identical size and shape and each having a wider longitudinal half portion and a narrower longitudinal half portion extending from the comb back to adjacent said remote end, said wider longitudinal half portion and said narrower longitudinal half portion of each tooth being uniformly tapered outwardly and oppositely from said central longitudinal plane by corresponding distances, said teeth being alternately inverted so that said wider longitudinal half portions alternate with said narrower longitudinal half portions at both faces of the comb, each wider longitudinal half portion including shoulders forming a pair of ledges where the wider longitudinal half portion joins said narrower longitudinal half portion at such central plane, the ledges of each tooth facing the narrower longitudinal half portion of the same tooth and being side by side with the shoulders of adjacent teeth, the shoulder ledges on adjacent teeth facing in opposite directions and forming a narrow jog in the passages between teeth, the shoulder ledges extending in general the length of the teeth.

* * * * *